US005162846A

United States Patent [19]

Cahill

[11] Patent Number: 5,162,846

[45] Date of Patent: Nov. 10, 1992

[54] COVER CONTROL MECHANISM

[75] Inventor: David F. Cahill, Rochester, N.Y.

[73] Assignee: Eastman Kodak Company, Rochester, N.Y.

[21] Appl. No.: 815,986

[22] Filed: Jan. 2, 1992

[51] Int. Cl.[5] ..... G03G 15/00

[52] U.S. Cl. ..... 355/200; 355/210

[58] Field of Search ..... 355/200, 210, 75, 308; 187/62, 66; 312/276; 206/45.13, 45.15, 45.18, 309, 444; 16/374, 82, 86 C

[56] References Cited

U.S. PATENT DOCUMENTS

| | | | |
|---|---|---|---|
| 4,555,173 | 11/1985 | Iseki et al. | 355/200 |
| 4,615,605 | 10/1986 | Kida et al. | 355/200 |
| 4,641,947 | 2/1987 | Ishida et al. | 355/200 |
| 4,969,010 | 11/1990 | Tamura et al. | 355/200 |

*Primary Examiner*—A. T. Grimley
*Assistant Examiner*—Sandra L. Brasé
*Attorney, Agent, or Firm*—J. Gary Mohr

[57] ABSTRACT

In a reproduction apparatus, such as a copier, having a document feeder mounted on top of a scanner, a restraining mechanism is provided to restrict the pivotal travel of the feeder in relation to the pivotal travel of the scanner. This restraining mechanism, while allowing the feeder to pivot from the scanner so that one may copy items such as books, restricts such pivoting in relation to the scanner, when the scanner is pivoted from its normal operation position. This prevents the feeder from pivoting to a point where it would make contact with objects to the rear of the copier that may damage the feeder.

The restraining mechanism is comprised of a cable connected to the feeder and the copier housing, with said cable being fed over cable guides, a sheave and a pendulum means. This restraining mechanism provides an interaction between the scanner and the feeder such that the greater the pivotal movement between the scanner and the copier housing, the lesser the pivotal movement between the scanner and the feeder. The pendulum means supports the sheave and also maintains the cable taut and in contact with the cable guides to prevent cable dislodgment and operational jamming.

3 Claims, 5 Drawing Sheets

COVER CONTROL MECHANISM

BACKGROUND OF THE INVENTION

The present invention generally relates to a reproduction apparatus, such as a copier which utilizes an electrophotographic process.

Currently, copiers which utilizes an electrophotographic process are generally required to be constructed such that a user can maintain the copier with relative ease. For example, sometimes, a paper jam must be remedied and to accomplish this it becomes necessary to pivot the feeder and the scanner from their normal operating positions to gain access to the location of the paper jam. However, if the feeder is located on top of the scanner and both the scanner and the feeder are capable of pivoting through an angle of 70 degrees or more about their individual pivot points, for normal operation and maintenance, the combined pivoting effect is 140 degrees or more. This may cause the feeder to make contact with objects located behind it resulting in damage to the feeder and other components of the copier, to which it is attached. The present invention, however, solves this problem by incrementally restraining the angle of pivot of the feeder, in relation to the angle of pivot of the scanner, while still providing the desired pivoting of the scanner and feeder to accomplish normal operation and maintenance. In other words, as the angle of pivot of the scanner, in relation to the copier housing, increases, the angle of pivot of the feeder, in relation to the scanner, decreases and visa versa.

SUMMARY OF THE INVENTION

It is an object of the present invention to provide a mechanism that prevents the feeder, when pivoted in relation to the scanner, from hitting objects behind the copier housing.

The above object is accomplished by a restraining means, installable in a reproduction apparatus that has a document feeder pivotally mounted on a scanner that is pivotally mounted on the reproduction apparatus wherein the restraining means controls the pivotal travel of the document feeder in relation to the pivotal travel of the scanner.

The invention, and its objects and advantages, will become more apparent in the detailed description of the preferred embodiment presented below.

DESCRIPTION OF THE PREFERRED EMBODIMENT

In describing the preferred embodiment of the present invention, reference is made to the drawings, wherein like numerals indicate like parts and structural features in the various views, diagrams and drawings.

Figure 1:
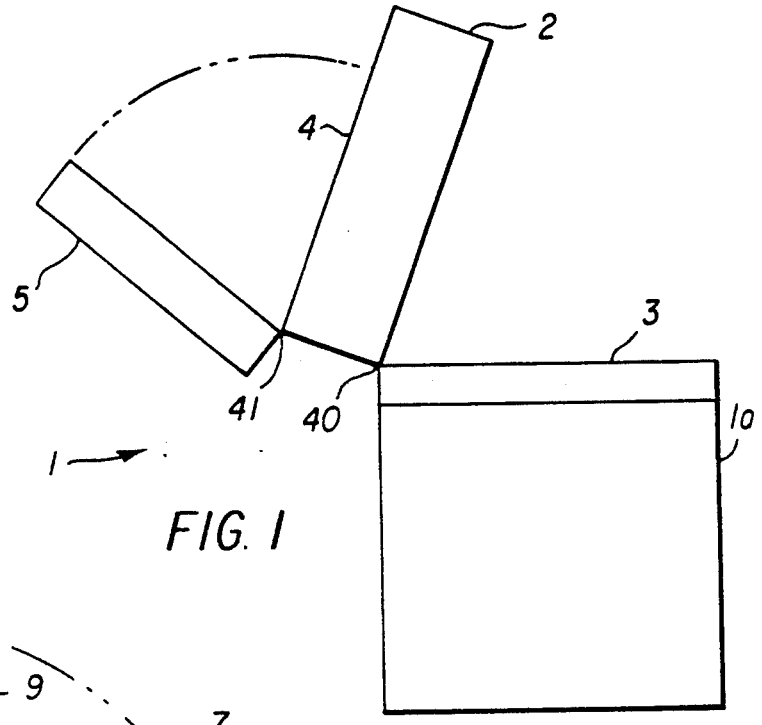
FIG. 1 is a schematic side view of a prior art reproduction apparatus with the scanner and document feeder pivoted to their fullest extent.

As shown in FIG. 1, a prior art reproduction apparatus 1, such as a copier, has a scanner 2 which is capable of pivoting up to a 70 degree angle about its pivot point 40, in relation to a top plane 3, of a copier housing 1*a*. This pivoting of scanner 2 is desirable to enable one to easily obtain access to the area below top plane 3 to correct problems, in this area, such as paper jams. Attached to a top plane 4, of scanner 2, is a document feeder 5 which may be pivoted, up to a 70 degree angle about a pivot point 41, in relation to top plane 4, of scanner 2. This degree of pivoting is desirable to enable one to easily place items, such as books, under feeder 5, for reading by scanner 2 and copying by copier 1 when scanner 2 is in its normal operating position parallel to top plane 3. Because both scanner 2 and feeder 5 are capable of being pivoted to a maximum of 70 degrees each, it is possible for the total pivot of feeder 5 to be 140 degrees from top plane 3 of copier housing 1*a*. With this being the case, feeder 5 may make contact with an object, such as a wall, located near or behind copier 1 causing damage to document feeder 5 or scanner 2.

Figure 2:
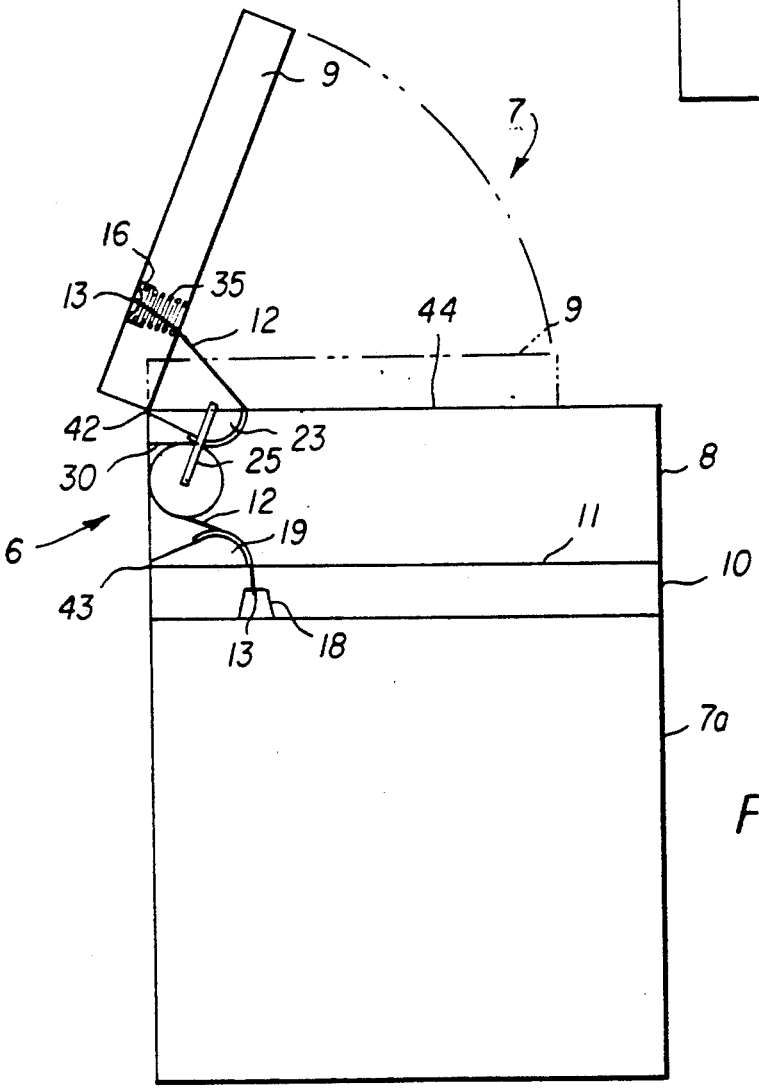
FIG. 2. is a schematic left side view of a reproduction apparatus with a scanner in its normal operating position and a document feeder in an open position, in accordance with the present invention, but with parts eliminated for clarity.
Figure 11:
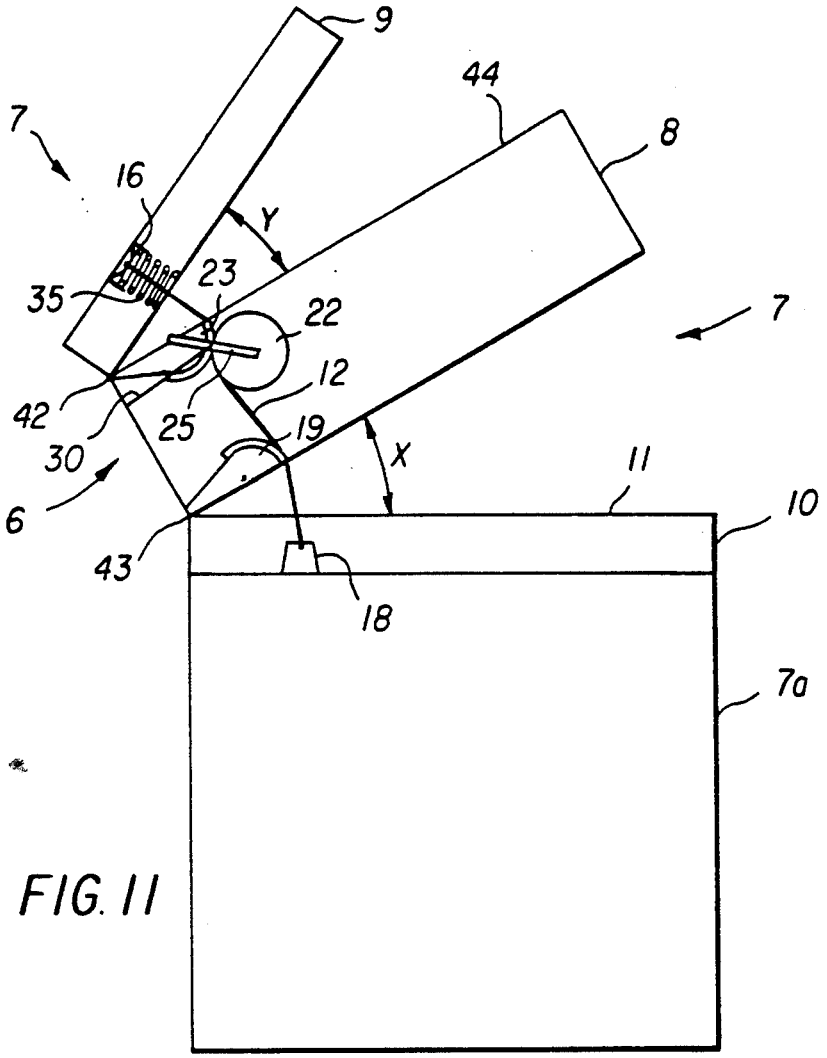
FIG. 11. is a schematic left side view of the reproduction apparatus showing the document feeder and the scanner with both the feeder and scanner partially pivoted from their normal operating positions and with parts eliminated for clarity.

As shown in FIG. 2, in the present invention, an apparatus 7, such as a reproduction apparatus or a copier, having an upper housing 9 pivotal on a center housing 8 which is pivotal on a main housing 7*a*, is provided with an incremental restraining mechanism 6. Restraining mechanism 6 allows upper housing 9, such as a document feeder, to pivot, about pivot point 42, preferably up to an angle of 70 degrees from a plane 44 of center housing 8, such as a scanner, to allow for the copying of such items as books, when scanner 8 is in its normal operating position parallel to a top surface 11 of main housing 7*a*, such as a copier housing. If, however, as shown in FIG. 11, scanner 8 is pivoted about pivot point 43, from its normal operating position, then the pivot angle of feeder 9, from plane 44 of scanner 8, is limited by the relationship $Y=70-X$ degrees, where Y is the angle between feeder 9 and top plane 44 of scanner 8 and X is the angle between top surface 11 of copier housing 7*a* and scanner 8. This avoids the possibility of feeder 9 making contact with objects behind copier 7, since for heat reasons objects are usually restricted from the rear of copier 7 to a distance greater than the distance that restraining mechanism 6 will allow feeder 9 to pivot. The preferred 70 degree angle of pivot for feeder 9, however, can be modified to suit individual needs by changing the size of components of restraining mechanism 6.

Figure 3:
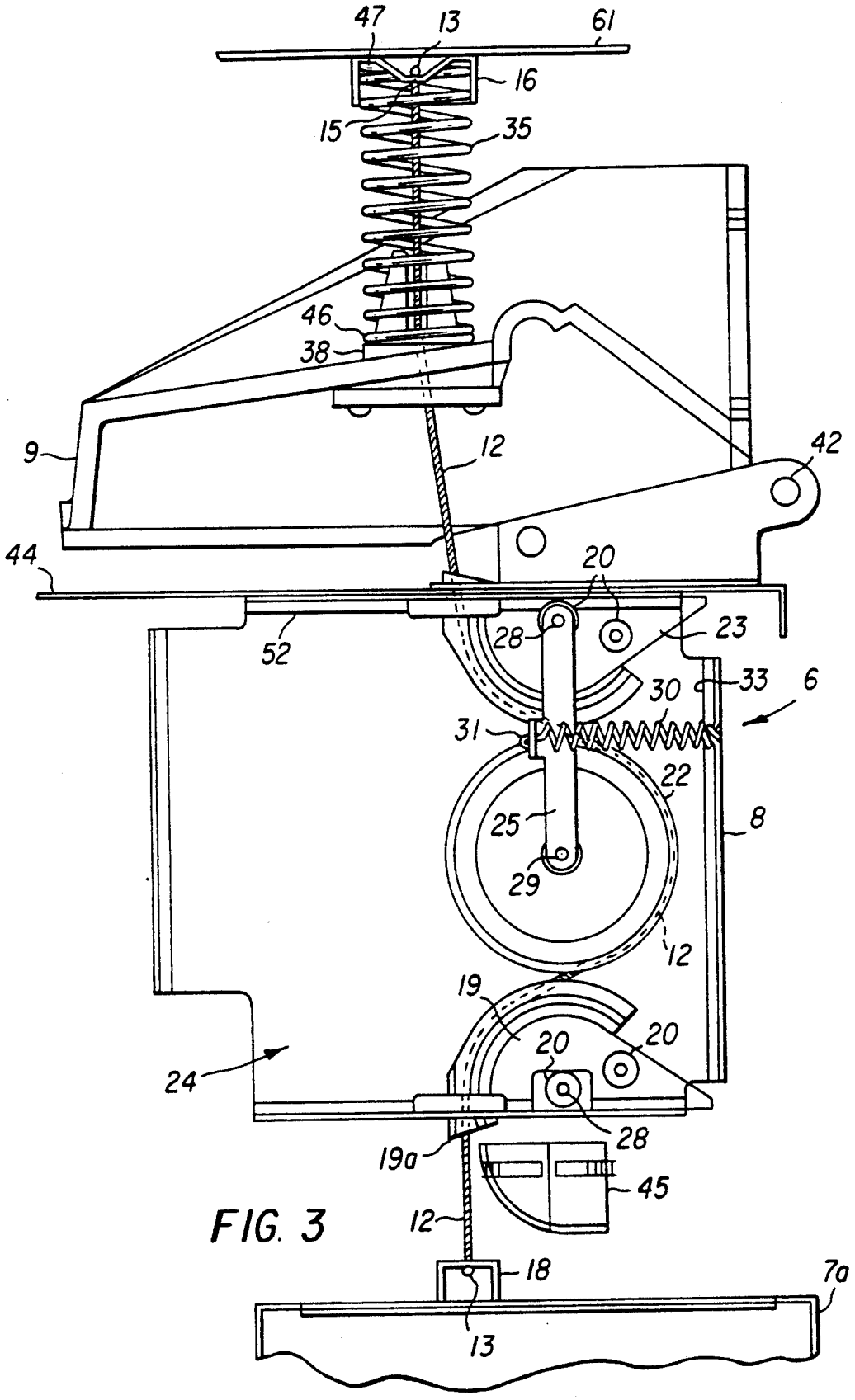
FIG. 3. is a schematic right side view of the restraining mechanism, in accordance with the present invention, but with only portions of the outer housings of the copier, scanner and document feeder being shown.
Figure 4:
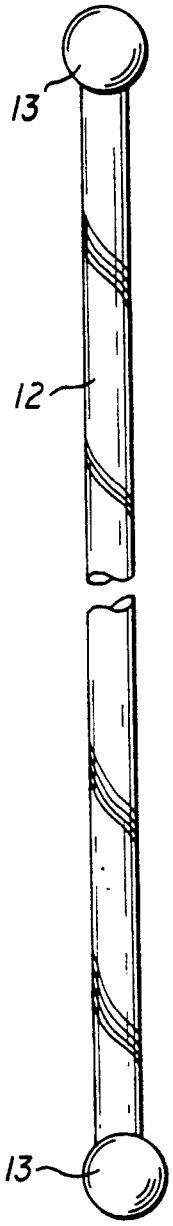
FIG. 4. is a side view of the cable of the restraining mechanism in accordance with the present invention.

As shown in FIG. 3, restraining mechanism 6 is comprised of a cable 12 having secured to it spherical ends 13, see FIG. 4, which are larger in diameter than the diameter of cable 12. One spherical end 13 is inserted in a top retaining housing 16 through an opening 14 of a slot 15, see FIG. 6. Opening 14 has a diameter larger than the diameter of spherical end 13 so that spherical end 13 maybe easily inserted into opening 14. Since opening 14 is located on a top surface 53, see FIG. 5, of top retaining housing 16, after insertion of spherical end 13 in opening 14, spherical end 13 is slid down the side of taper 50 of top retaining housing 16 into slot 15. Because slot 15 has a width less than the diameter of spherical end 13 and spherical end 13 must travel up taper 50, in opposition to the force of a compensation spring 35 located under top retaining housing 16, see FIG. 3, in order to dislodge itself from slot 15, there is little chance that spherical end 13 will dislodge from slot 15. By securing spherical end 13, in this manner, spherical end 13 is allowed to freely pivot in slot 15 so as not to restrain operational movement of cable 12, but still maintain cable 12 centrally positioned in retaining housing 16.

Figure 5:
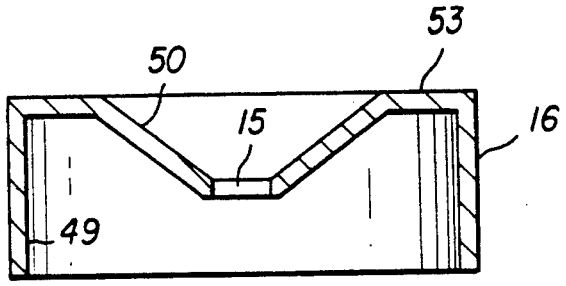
FIG. 5. is a schematic side view of the top retaining housing in accordance with the present invention.
Figure 6:
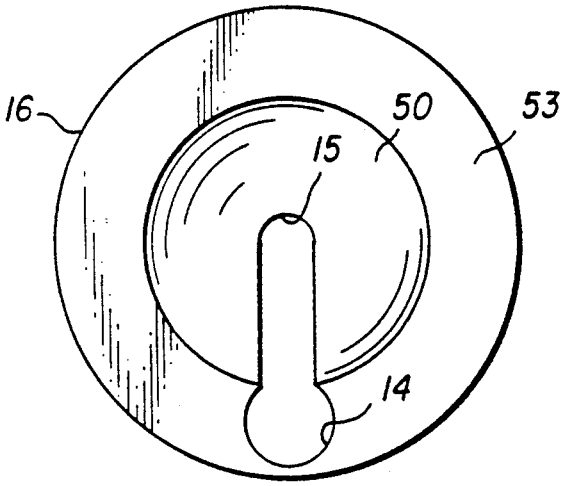
FIG. 6. is a top view of the top retaining housing in accordance with the present invention.

As shown in FIG. 5 top retaining housing 16 has tapers 48 which, when inserted into a compensation spring 35, maintain compensation spring 35 centered within walls 49 of top retaining housing 16, as shown in FIG. 3. By positioning retaining housing 16 in this manner, on compensation spring 35, with one end 46 of compensation spring 35 mounted to a frame 38, of document feeder 9, and the other end 47 mounted under top retaining housing 16, as compensation spring 35 pushes retaining housing 16 upwards, both the underside of the outer housing 61, of feeder 9, and spherical end 13, mounted in slot 15 prevents retaining housing 16 from moving upward. Only the force of compensation spring 35, however, prevents top retaining housing 16 from moving downward from the underside of outer housing 61.

Figure 10:
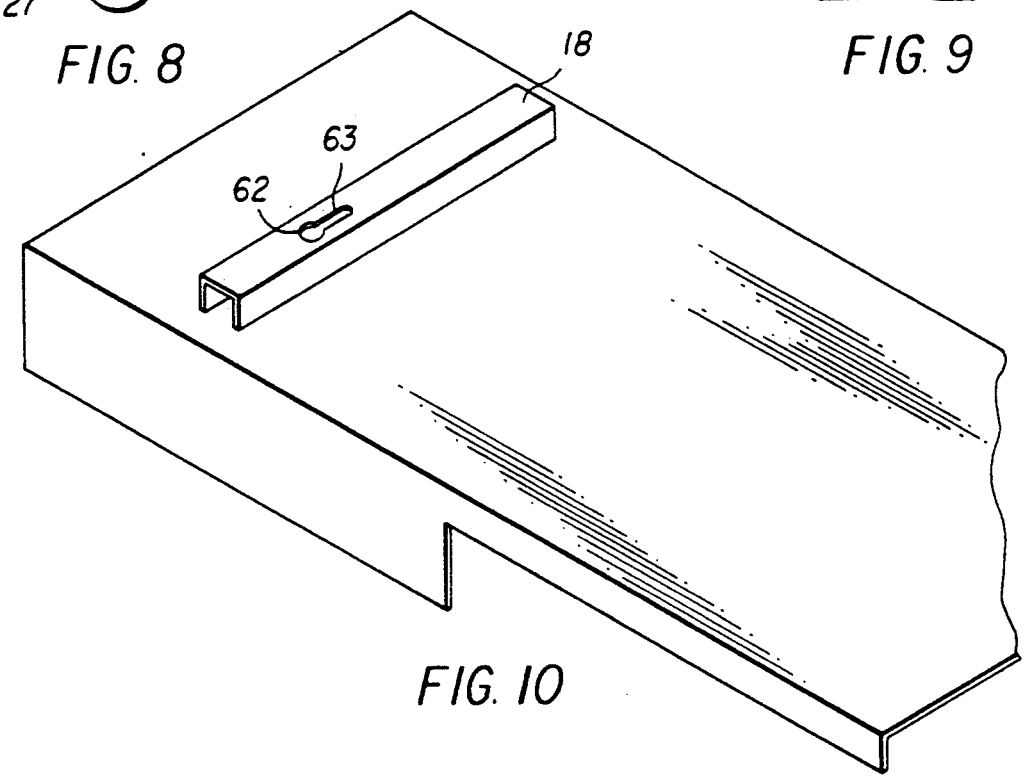
FIG. 10. is a perspective view of a lower mounting housing of the reproduction apparatus in accordance with the present invention.

The other spherical end 13 of cable 12 is secured to lower mounting housing 18, as shown in FIG. 10. Housing 18 has an opening 62 for inserting spherical end 13 in housing 18 and a slot 63 for securing spherical end 13 of cable 12 into housing 18. This is accomplished by having opening 62 larger in diameter than spherical end 13 and the width of slot 63 less than the diameter of spherical end 13. Like spherical end 13, mounted in retainer housing 16, spherical end 13 mounted in housing 18 is freely pivotal in housing 18 so as not to interfere with the operational movement of cable 12.

Figure 7:
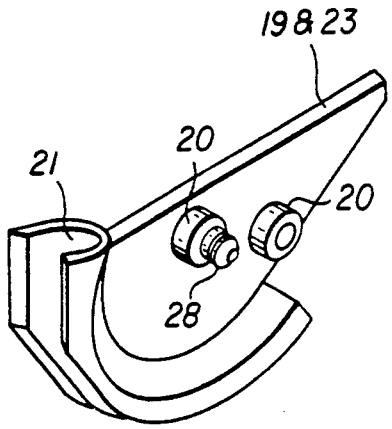
FIG. 7. is a perspective view of a cable guide in accordance with the present invention.
Figure 8:
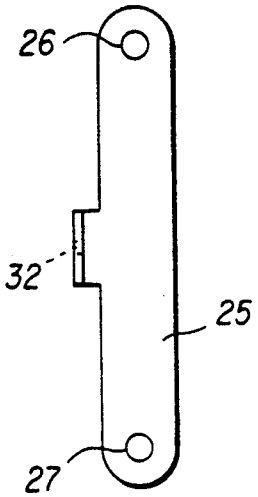
FIG. 8. is a schematic side view of the pendulum in accordance with the present invention.
Figure 9:
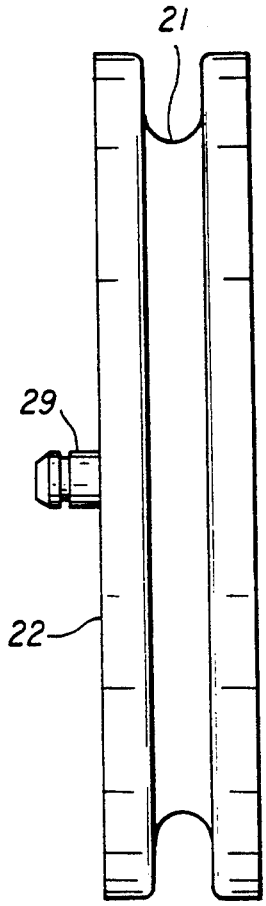
FIG. 9. is a schematic side view of the idler sheave in accordance with the present invention.

As shown in FIG. 3, cable 12, starting from housing 18 is located adjacent to a smooth edge guide 45, normally not in contact with cable 12 and which will be discussed later. Cable 12 is then fed over guide 19 which is secured, in a fixed position, to an inside wall 24 of scanner 8 by securing pins 20. As further shown in FIG. 7, guide 19 has a groove 21 to guide and assist in retaining cable 12 in contact with guide 19 as cable 12 slides over guide 19 during the pivoting of scanner 8 or feeder 9. After cable 12 is fed over guide 19 it is fed around idler sheave 22, which has a groove 21, similar to guide 19, to guide and retain cable 12 in contact with sheave 22 as cable 12 slides over sheave 22 during pivoting of scanner 8 or feeder 9. From sheave 22, cable 12 is fed over guide 23 which is secured to inside wall 24 of scanner 8 in a fixed position. Guide 23 is identical to guide 19, in configuration, to conserve on the number of different parts needed for restraining mechanism 6. However, guide 23, unlike guide 19, has attached to it pendulum 25, see FIG. 8, having mounting holes 26 and 27. Mounting hole 26, of pendulum 25, is sized to fit over pivot pin 28 of guide 23 so that pendulum 25, once secured to pivot pin 28, by a retaining means such as a "C" clamp, is free to pivot about pivot pin 28. Mounting hole 27, on the other hand, is sized to fit over sheave pivot pin 29, see FIG. 9, of sheave 22 so that pendulum 25, once secured to sheave pivot pin 29 by a "C" clamp, is free to pivot about sheave pivot pin 29.

As shown in FIG. 3, further attached to pendulum 25, is a tension spring 30. One end of tension spring 30 is secured to pendulum 25 by spring retainer 31 which mounts through the center 32 of pendulum 25. The other end of tension spring 30 is secured to inside wall 33 of scanner 8. Tension spring 30 thereby urges sheave 22 toward inside wall 33 of scanner 8, to continually maintain cable 12 taut and in contact with guides 19 and 23 and sheave 22. By maintaining cable 12 taut and in contact with guides 19 and 23 and sheave 22, cable 12 will not become dislodged from guides 19 and 23 or sheave 22 and thereby become entangled and non-operational.

The force that tension spring 30 exerts on sheave 22, is sufficient to overcome the weight of sheave 22 and the force necessary to keep cable 12 taut and in contact with sheave 22, without interfering with the operation of restraining mechanism 6 or being of sufficient force to cause feeder 9 to move. While the force of tension spring 30 is preferably about one pound, it may be adjusted to accommodate different sheave and cable weights.

To prevent feeder 9 from having a hard stop, at the end of its pivotal travel, compensation spring 35 acts as a damper, by compressing when feeder 9 is pivoted past a certain position. This compression of compensation spring 35 makes available an additional length of cable 12, under dampened conditions, to allow feeder 9 to come to a gradual, rather than an abrupt, stop. This additional dampened travel is then reversed as compensation spring 35 returns to its normal uncompressed state. By providing a gradual stop, as opposed to an abrupt stop, damage is less likely to occur to feeder 9 if one abuses feeder 9 by slamming it into its maximum open position.

As can be seen from FIG. 3, if scanner 8 is pivoted about it pivot point, cable 12 will come into contact with smooth edge guide 45. Smooth edge guide 45 transitions cable 12, such that a sharp bend in cable 12, at front edge 19*a* of guide 19, is avoided whenever scanner 8 is pivoted from its normal position for copying documents. By avoiding such a sharp bend the life of cable 12 is prolonged.

Figure 12:
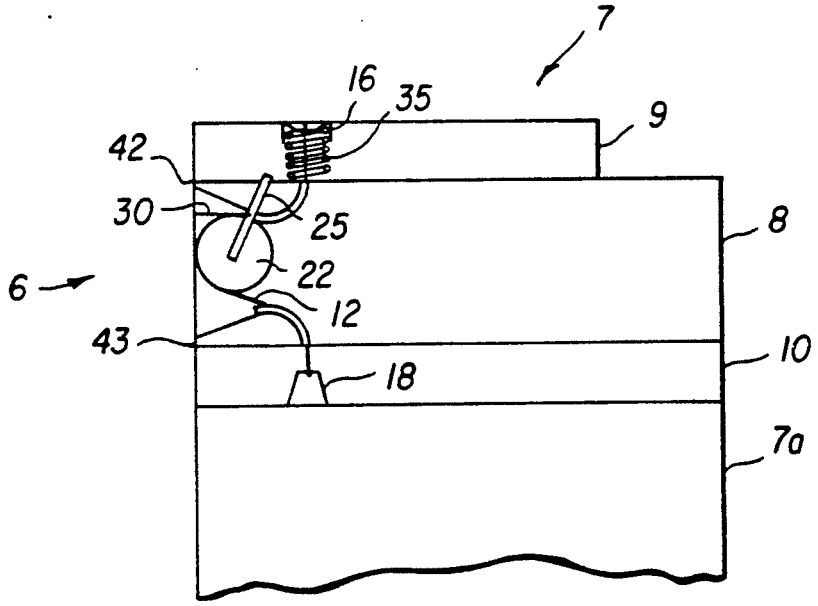
FIG. 12. is a schematic left side view of the reproduction apparatus with the document feeder and the scanner in their normal operating positions for copying flat documents and with parts eliminated for clarity.

When scanner 8 and feeder 9 are in their non-pivotal positions for copying flat documents, as shown in FIG. 12, cable 12 is maintained taut and in contact with guides 19 and 23 and sheave 22 by the force of tension spring 30 on pendulum 25. Once, however, either, or both, scanner 8 and feeder 9 are pivoted about their pivot points 43 and 42, cable 12 begins to interact with guides 19 and 23 and sheave 22. This interaction causes sheave 22, as shown in FIG. 3, to rotate with pendulum 25 in a clockwise direction as scanner 8 or feeder 9, or both, are pivoted about their pivot points in a clockwise motion. This clockwise pivoting causes whatever amount of cable 12 that was available to allow pivotal movement of feeder 9, to be incrementally reduced as clockwise pivoting of scanner 8 continues. This incremental reduction of cable 12 continues until the contact points of cable 12 with guide 19, sheave 22 and guide 23 fall in the same plane signifying that scanner 8 is pivoted to its maximum, preferably 70 degrees, and feeder 9 is parallel with the top surface 44 of scanner 8. Therefore, in operation if only feeder 9 is being pivoted, there is enough cable 12 to allow feeder 9 to pivot to its maximum travel which is preferably 70 degrees in relation to top surface 44 of scanner 8, which is sufficient to copy items such as books, however, if scanner 8 is also being pivoted, the amount feeder 9 can pivot, as to top surface 44 of scanner 8, is limited by the relation $Y=70-X$ degrees.

While the invention has been described in detail with particular reference to a preferred embodiment thereof, it will be understood that variations and modifications can be effected within the spirit and scope of the invention as described hereinabove and as defined in the appended claims.

I claim:

1. A reproduction apparatus including:

a main housing, a scanner housing mounted on top of the main housing and pivotable with respect to the main housing in a given angular direction with respect to the main housing, a feeder housing mounted on top of the scanner housing and pivotal in the same given angular direction with respect to the scanner housing, means for restricting total angular displacement of the feeder housing with respect to the main housing without substantially affecting angular displacement of the scanner housing with respect to the main housing.

2. The reproduction apparatus of claim 1 wherein said restricting means is a cable connected to said feeder housing and said main housing.

3. The reproduction apparatus of claim 2 further including means supported by said scanner housing for maintaining tension on said cable when said feeder housing is less than fully pivoted with respect to said main housing.

* * * * *